US007017848B2

(12) United States Patent
Fleming

(10) Patent No.: US 7,017,848 B2
(45) Date of Patent: Mar. 28, 2006

(54) CABLE REEL

(76) Inventor: Thomas William Fleming, Jamesbrook, Middleton, Co. Cork (IE)

( * ) Notice: Subject to any disclaimer, the term of this patent is extended or adjusted under 35 U.S.C. 154(b) by 0 days.

(21) Appl. No.: 10/450,950

(22) PCT Filed: Dec. 19, 2001

(86) PCT No.: PCT/IE01/00157

§ 371 (c)(1),
(2), (4) Date: Aug. 18, 2003

(87) PCT Pub. No.: WO02/49949

PCT Pub. Date: Jun. 27, 2002

(65) Prior Publication Data

US 2004/0065765 A1 Apr. 8, 2004

(30) Foreign Application Priority Data

Dec. 19, 2000 (IE) ..... S2000/1044

(51) Int. Cl.
*B65H 75/40* (2006.01)

(52) U.S. Cl. ..... 242/405.3; 242/405; 242/395; 242/395.1

(58) Field of Classification Search ..... 242/405.3, 242/405, 395, 395.1
See application file for complete search history.

(56) References Cited

U.S. PATENT DOCUMENTS

| | | | | |
|---|---|---|---|---|
| 2,133,337 | A | 10/1938 | Zvanut | |
| 2,268,996 | A * | 1/1942 | Young | 242/404.3 |
| 2,393,613 | A | 1/1946 | Combs | |
| 3,143,316 | A | 8/1964 | Shapiro | |
| 3,481,557 | A | 12/1969 | Miller | |
| 3,885,752 | A | 5/1975 | Noffsinger | |
| 4,014,477 | A * | 3/1977 | Hyun | 242/395 |
| 4,022,398 | A | 5/1977 | Youngblood | |
| 5,186,411 | A * | 2/1993 | Fanning et al. | 242/405.3 |
| 5,695,148 | A * | 12/1997 | Christensen | 242/405.3 |

FOREIGN PATENT DOCUMENTS

FR 2204188 A 5/1974

* cited by examiner

*Primary Examiner*—Kathy Matecki
*Assistant Examiner*—Sang Kim
(74) *Attorney, Agent, or Firm*—Birch, Stewart, Kolasch & Birch, LLP

(57) ABSTRACT

A hand-held cable reel (1) is provided comprising a central cable receiving core (2) mounted between a pair of disc-like end flanges (3) having through holes (4) for receiving cable which can then be anchored on the flange (3) by, for example, wrapping it round one of the handles (6) which are offset from the core (2) and each other to facilitate the winding and unwinding of cable.

24 Claims, 3 Drawing Sheets

CABLE REEL

This application is the national phase under 35 U.S.C. § 371 of PCT International Application No. PCT/IE01/00157 which has an International filing date of Dec. 19, 2001, which designated the United States of America.

BACKGROUND OF THE INVENTION

The present invention relates to a hand-held cable reel comprising a central cylindrical cable receiving core mounted between a pair of disc-like end flanges.

Generally speaking cable reels for rope, electric cable and the like are often carried by one person who pays out cable from the reel until sufficient cable has been payed out when the cable is then locked or tied around the reel in someway often by means of being jammed into a Vee-shaped notch in the rim of the flanges or end caps which are generally circular discs. This is not particularly satisfactory and very often the cable unravels from the reel.

In this specification the term "cable" is used to encompass not only wire rope but other flexible rope such as hemp rope, manmade fibre ropes and the like cable, livestock restraining electric fencing cable and tapes generally. Essentially anything that would be wrapped around a hand-held reel is encompassed within the term "cable".

For example, it is known to provide a cable reel comprising a core rotatable by means of a handle such as, for example, described in U.S. Pat. No. 4,072,278 (Petersen) and is of a relatively complex construction. It is also known, for example, to provide kite control reels such as is described in U.S. Pat. No. 4,796,827. Again, this is a relatively complex arrangement.

There is not a simple device which is efficient in use and at the same time is inexpensive. The present invention is directed towards providing such a hand-held cable real.

BRIEF SUMMARY OF THE INVENTION

According to the invention, there is provided a hand-held cable reel comprising a central cylindrical cable receiving core mounted between a pair of disc-like end flanges characterized in that each flange has a handle projecting laterally from the outermost surface of the flange, the handles being radially offset from the central axis of the core and circumferentially offset relative to each other.

The advantage is that the handles can be gripped and the reel wrapped around itself. As the handles are offset, it is a relatively easy task for users towrap the reel around the axis. This is particularly advantageous when the cable is in tension as the offset handles allow the user to exert sufficient force on the cable.

In one embodiment of the invention, each flange has a plurality of cable receiving through holes. Because of the provision of the holes, it is possible to lead the free end of the cable through one hole around a handle and then back through the hole or indeed through another hole to anchor the cable. Thus ideally the holes have a cross sectional area at least twice as large as that of the cross-sectional area of the cables but not so large as to have the cables easily move through the holes. Thus when a cable is passed out through the hole in one direction and then back around the handle or other suitable projection and then back through the hole in the other direction, the cable will effectively be jammed in the hole.

Ideally, the flanges are circular and the holes are arranged circumferentially around each end cap adjacent the outer edge thereof.

In one embodiment of the invention, the holes are of different sizes.

In another embodiment of the invention, the holes incorporate a Vee-shaped cable receiving notch.

In a still further embodiment of the invention, there is provided a jamb cleat or a plurality of bollards on the outermost surface of each flange.

In another embodiment of the invention, the handles are mounted by hinges and in a still further embodiment of the invention, the handles are telescopic handles.

In a still further embodiment of the invention, each handle has a circumferentially arranged cable receiving groove, Vee-shaped in cross-section.

BRIEF DESCRIPTION OF THE SEVERAL VIEWS OF THE DRAWINGS

The invention will be more clearly understood from the following description of some embodiments thereof, given by way of example only, with reference to the accompanying drawings, in which.

DETAILED DESCRIPTION OF THE INVENTION

Figure 3:
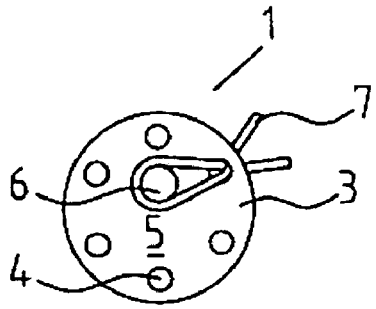
FIG. 3 is a left hand end view of the reel.
Figure 4:
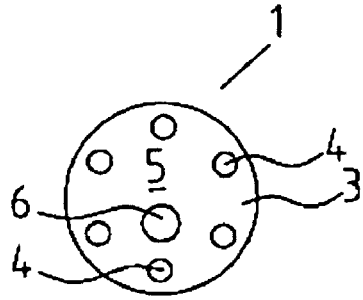
FIG. 4 is a right hand end view of the reel.
Figure 2:
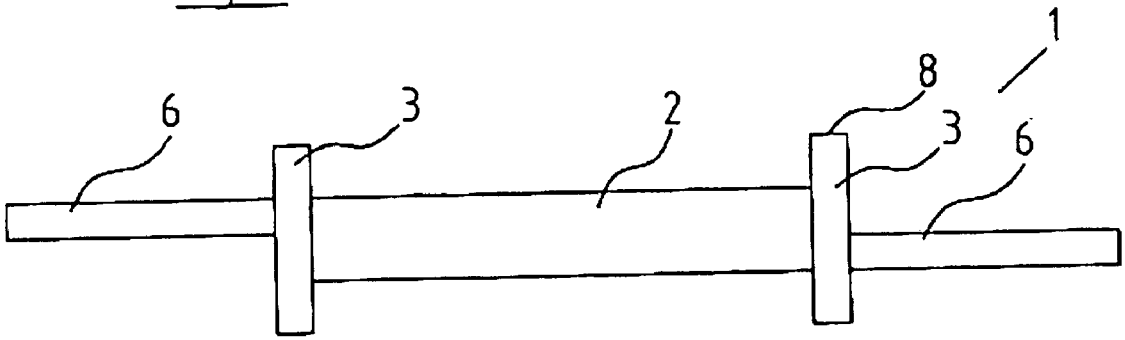
FIG. 2 is a side view of the reel.
Figure 1:
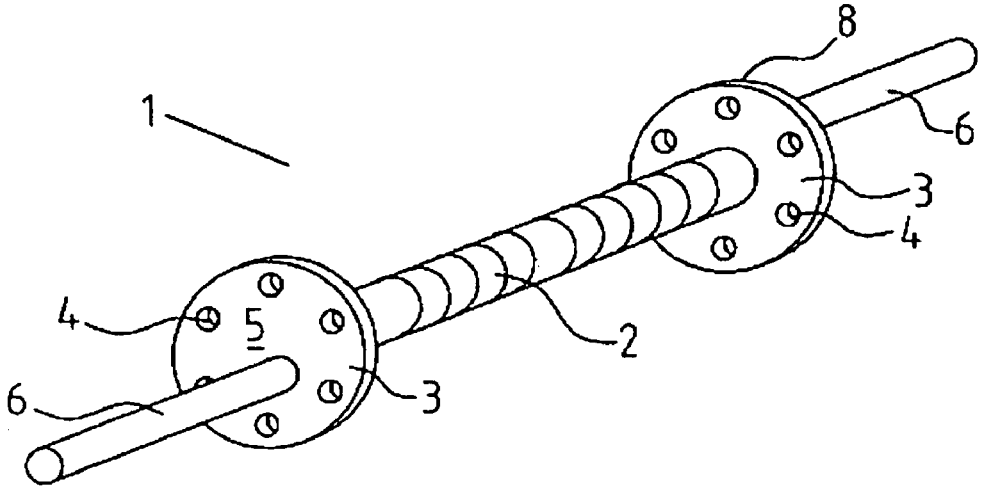
FIG. 1 is a typical view of a cable reel according to the invention.

Referring to the drawing and initially to FIGS. 1 to 4 thereof, there is provided a hand-held cable reel, indicated generally by the reference numeral 1, comprising, a tubular central spine forming a core 2 mounted between a pair of circulardisc like end flanges 3 having a plurality of circumfrentially arranged cable receiving through holes 4 adjacent the outer edge 8 thereof. Each end flange 3 carries on its outermost face 5*a* laterally projecting handle 6 which is radially offset from the central axis of the core 2. The handles 6 are also circumferentially spaced or offset with respect to each other on the end caps 3. The cable is identified by the reference numeral 7 in FIG. 3.

In use, cable 7 is wrapped round the core 2 in conventional manner and the cable reel 1 can be easily used to wand up cable 7 or to pay it out because the handles 6, being offset greatly facilitate manipulation and rotation of the cable reel 1. When it is desired to lock the cable 7 on the cable reel 1, the cable 7 is lead through one of the holes 4 round about the handle 6 back trough the same hole 4 on itself thus anchoring it.

Figure 5:
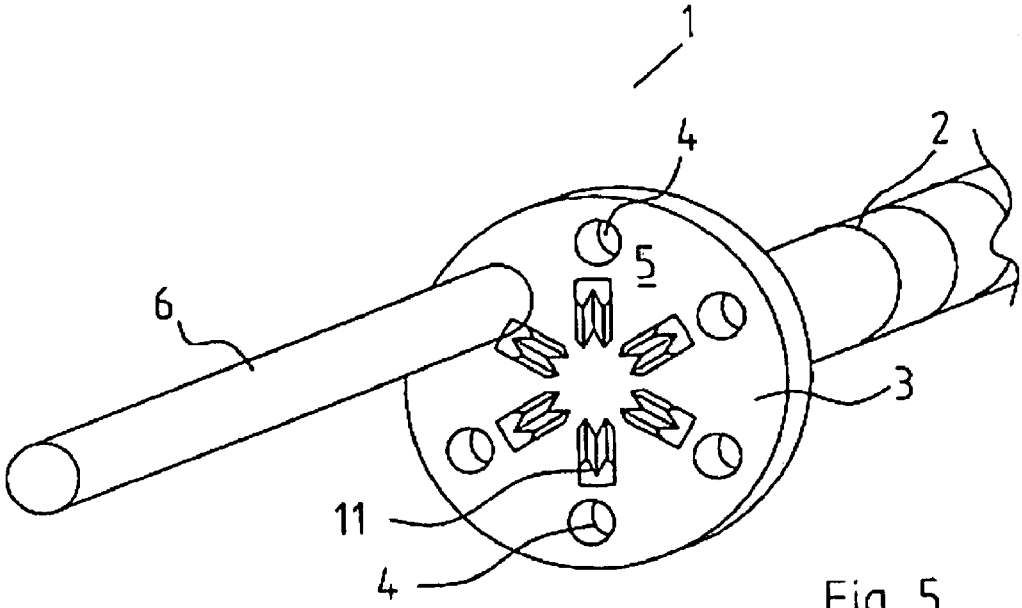
FIG. 5 is a perspective, partially cutaway view of an alternative construction of reel according to the invention.

Referring now to FIG. 5, there is illustrated an alternative construction of cable reel, again indicated generate by the reference numeral 1. In this embodiment parts similar to those described with reference to the previous drawings are identified by the same reference numerals. In this embodiment the cable real 1 is provided adjacent each hole 4 with a Vee-shaped jamb cleat 11 of conventional construction. In this embodiment cable can be lead through one of the holes 4 and anchored by means of one of the jam cleats 11.

Figure 6:
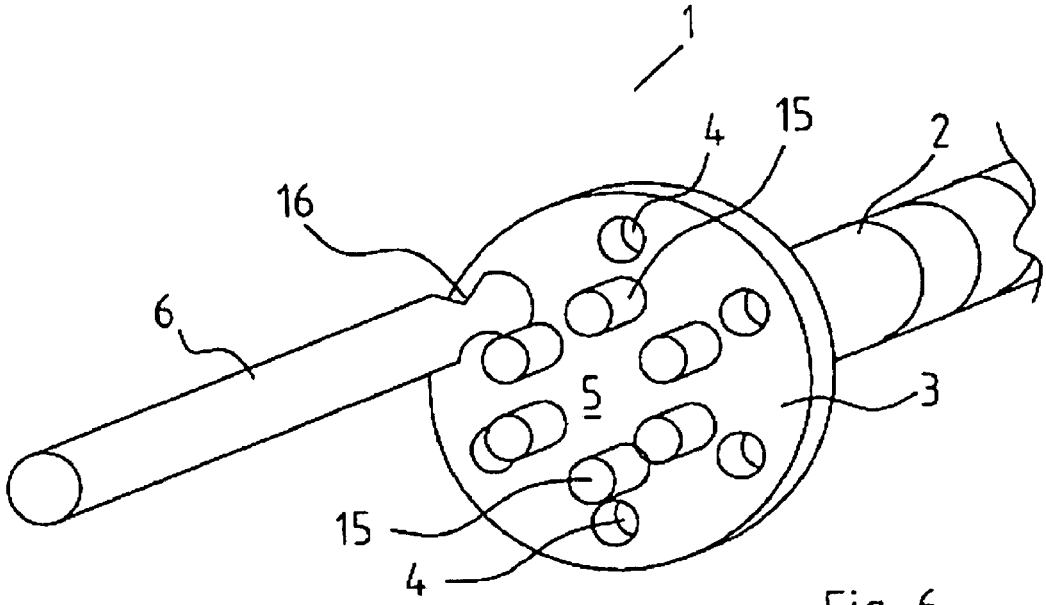
FIG. 6 is a perspective view partially cut away view of an alternative construction of reel according to the invention.

Referring to FIG. 6, there is illustrated an alternative construction of cable reel, again indicated generally by the reference numeral 1. In this embodiment parts similar to those described with reference to the previous are identified by the same reference numerals. In this embodiment adjacent each hole 4 there is mounted a bollard 15 around which cable maybe wound so as to anchor the cable. Further there is provided a cable receiving groove 16 on the handle 6 adjacent the outer face 5 of the end cap 3 which can also be used to anchor cable. Ideally the groove 16 is Vee shaped in cross section to have a jamming section on the cable.

Figure 7:
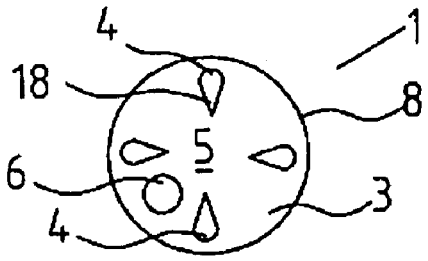
FIG. 7 is an end view of an alternative construction of cable reel according to the invention.

Referring to FIG. 7, there is illustrated another construction of cable reel, again indicated generally by the reference numeral 1, in which parts similar to those described with reference to the previous drawings are identified by the same reference numerals. In this embodiment, each hole 4 Incorporates a Vee-shaped cable receiving notch 18. It is envisaged that instead of having holes of the shape illustrated, they could simply be triangular holes into which the cable can be jammed.

Figure 8:
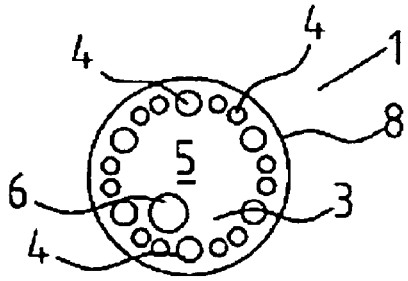
FIG. 8 is an end view similar to FIG. 7 of a still further construction of cable reel.

FIG. 8 illustrated an alternative construction of cable reel, again indicated generally by the reference numeral 1, comprising a plurality of holes 4 of different sizes, arranged circumferentially around each flange 3 adjacent the outer edge 8 thereof.

Figure 9:
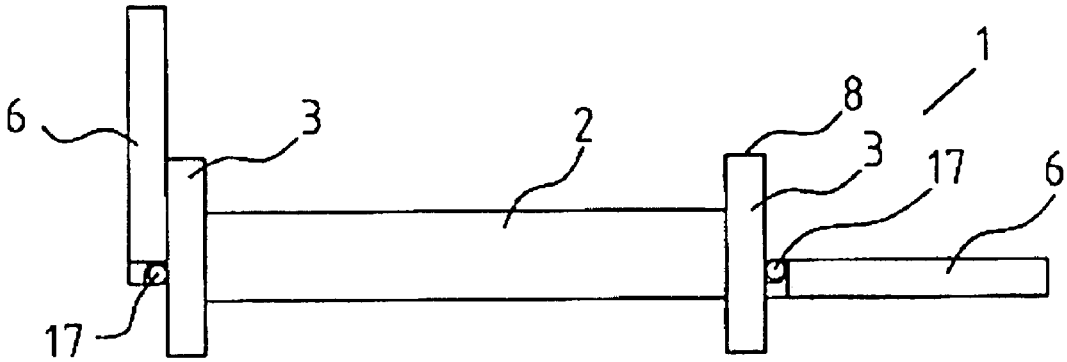
FIG. 9 is a side view of a still further cable reel according to the invention.

FIG. 9 illustrates a still further construction of cable reel, again indicated generally by the reference numeral 1, in which parts similar to those described with reference to the previous drawings, are identified by the same reference numerals. In this embodiment, each handle 6 is connected to it's respective flange 3 by a hinge 17. On the right-hand side of the drawing, the handle is shown in the operative position and on the left-hand side of the drawing, it is shown in the folded position.

Figure 10:
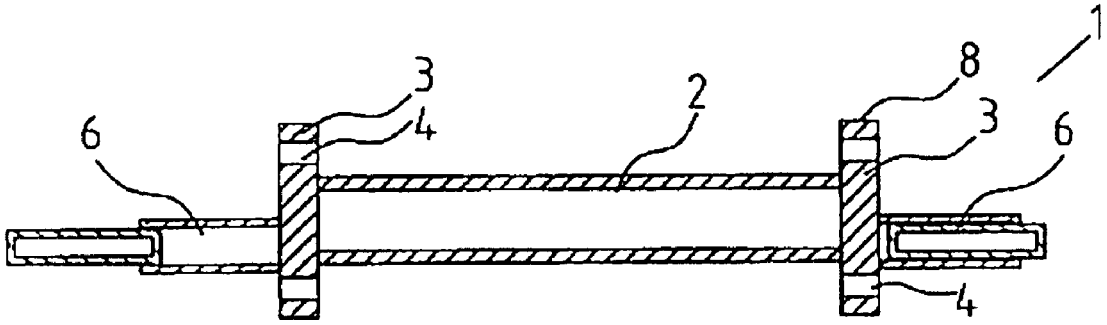
FIG. 10 is a side sectional view of a still further cable reel according to the invention.

FIG. 10 illustrates a still further construction of handle 6, in this case, a telescopic handle 6, one of which is shown collapsed on the right-hand side of the drawing and the other in the extended position on the left-hand side of the drawing.

In the specification the terms "comprise, comprises, comprised and comprising" or any variation thereof and the terms "include, includes included and including" or any variation thereof are considered to be totally interchangeable and they should all be afforded the widest possible interpretation and vice versa.

The invention is not limited to the embodiment hereinbefore described, but may be varied in both construction and detail.

What is claimed is:

1. A hand-held cable reel (1) comprising a central cylindrical cable receiving core (2) mounted between a pair of end flanges (3) each flange (3) has a handle (6) projecting laterally from an outermost surface (5) of the flange (3), the handles (6) being radially offset from the central axis of the core (2) and circumferentially offset relative to each other, the handles are mounted by hinges (17), wherein each flange has a plurality of cable receiving through holes and a plurality of cable anchoring bollards (15) mounted on the outermost surface (5) of each flange (3) so that a cable may be secured by passing the cable through one of the cable receiving through holes, leading the cable around one of the bollards and passing the cable back through the same cable receiving through hole.

2. The cable reel (1) as claimed in claim 1, in which the flanges (3) are circular and the holes (4) are arranged circumferentially around each end cap adjacent to an outer edge (8) thereof.

3. The cable reel (1) as claimed in claim 2, in which the holes (4) are of different sizes.

4. The cable reel (1) as claimed in claim 2, in which the holes (4) incorporate a Vee-shaped cable receiving notch (18).

5. The cable reel (1) as claimed in claim 1, comprising a jamb cleat (11) mounted on the outermost surface (5) of each flange (3).

6. The cable reel (1) as claimed in claim 1, in which the handles (6) are telescopic handles.

7. The cable reel (1) as claimed in claim 1, in which each handle (6) has a circumferentially arranged cable receiving groove (16), Vee-shaped in cross-section.

8. A hand-held cable reel (1) comprising a central cylindrical cable receiving core (2) mounted between a pair of end flanges (3) each flange (3) has a handle (6) projecting laterally from an outermost surface (5) of the flange (3), the handles (6) being radially offset from the central axis of the core (2) and circumferentially offset relative to each other, the handles (6) are mounted by hinges (17), wherein each flange has a plurality of cable receiving through holes and a plurality of cable anchoring projections mounted on the outermost surface (5) of each flange (3) so that a cable may be secured by passing the cable through one of the cable receiving through holes, leading the cable around one of the projections and passing the cable back through the same cable receiving through hole.

9. The cable reel (1) as claimed in claim 8, in which the flanges (3) are circular and the holes (4) are arranged circumferentially around each end cap adjacent an outer edge (8) thereof.

10. The cable reel (1) as claimed in claim 8, in which the holes (4) are of different sizes.

11. The cable reel (1) as claimed in claim 8, in which the holes (4) incorporate a Vee-shaped cable receiving notch (18).

12. The cable reel (1) as claimed in claim 8, comprising a jamb cleat (11) mounted on the outermost surface (5) of each flange (3).

13. The cable reel (1) as claimed in claim 8, in which the handles (6) are telescopic handles.

14. The cable reel (1) as claimed in claim 8, in which each handle (6) has a circumferentially arranged cable receiving groove (16), Vee-shaped in cross-section.

15. A hand-held cable reel (1) comprising a central cylindrical cable receiving core (2) mounted between a pair of end flanges (3) each flange (3) has a handle (6) projecting laterally from an outermost surface (5) of the flange (3), the handles (6) being radially offset from the central axis of the core (2) and circumferentially offset relative to each other, the handles (6) are telescopic handles, wherein each flange has a plurality of cable receiving through holes and a plurality of cable anchoring bollards (15) mounted on the outermost surface (5) of each flange (3) so that a cable may be secured by passing the cable through one of the cable receiving through holes, leading the cable around one of the bollards and passing the cable back through the same cable receiving through hole.

16. The cable reel (1) as claimed in claim 15, in which the flanges (3) are circular and the holes (4) are arranged circumferentially around each end cap adjacent to an outer edge (8) thereof.

17. The cable reel (1) as claimed in claim 16, in which the holes (4) are of different sizes.

18. The cable reel (1) as claimed in claim 15, comprising a jamb cleat (11) mounted on the outermost surface (5) of each flange (3).

19. The cable reel (1) as claimed in claim 15, in which each handle (6) has a circumferentially arranged cable receiving groove (16), Vee-shaped in cross-section.

20. A hand-held cable reel (1) comprising a central cylindrical cable receiving core (2) mounted between a pair of end flanges (3) each flange (3) has a handle (6) projecting laterally from an outermost surface (5) of the flange (3), the handles (6) being radially offset from the central axis of the core (2) and circumferentially offset relative to each other, the handles (6) are telescopic handles, wherein each flange has a plurality of cable receiving through holes and a plurality of cable anchoring projections mounted on the outermost surface (5) of each flange (3) so that a cable may be secured by passing the cable through one of the cable receiving through holes, leading the cable around one of the projections and passing the cable back through the same cable receiving through hole.

21. The cable reel (1) as claimed in claim 20, in which the flanges (3) are circular and the holes (4) are arranged circumferentially around each end cap adjacent an outer edge (8) thereof.

22. The cable reel (1) as claimed in claim 20, in which the holes (4) are of different sizes.

23. The cable reel (1) as claimed in claim 20, comprising a jamb cleat (11) mounted on the outermost surface (5) of each flange (3).

24. The cable reel (1) as claimed in claim 20, in which each handle (6) has a circumferentially arranged cable receiving groove (16), Vee-shaped in cross-section.

* * * * *